US011268768B2

(12) United States Patent
Tapley et al.

(10) Patent No.: US 11,268,768 B2
(45) Date of Patent: Mar. 8, 2022

(54) EVAPORATIVE COOLING SYSTEM

(71) Applicant: Westinghouse Air Brake Technologies Corporation, Pittsburgh, PA (US)

(72) Inventors: Joseph Theodore Tapley, Medon, TN (US); Daniel Edward Sikes, Jackson, TN (US); Jay S. Korth, Jackson, TN (US); Joshua Jared Shoemaker, Jackson, TN (US); Carson Mae Brown, Cunningham, KY (US); Corbin Abel Anderson, Nashville, TN (US)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 0 days.

(21) Appl. No.: 16/391,818

(22) Filed: Apr. 23, 2019

(65) Prior Publication Data

US 2019/0323776 A1 Oct. 24, 2019

Related U.S. Application Data

(60) Provisional application No. 62/661,445, filed on Apr. 23, 2018.

(51) Int. Cl.
*F28D 5/00* (2006.01)

(52) U.S. Cl.
CPC ..... *F28D 5/00* (2013.01)

(58) Field of Classification Search
CPC ..... F28D 5/02; F28D 5/00; F25B 39/04
See application file for complete search history.

(56) References Cited

U.S. PATENT DOCUMENTS 5,377,500 A * 1/1995 Yang ..... F25B 39/04 62/238.6
9,803,929 B2 * 10/2017 Aaron ..... F28D 5/02
2011/0023506 A1 * 2/2011 Day ..... F24F 5/0035 62/91
2011/0272967 A1 * 11/2011 Davisdon ..... B60R 19/52 296/193.1
2012/0036877 A1 * 2/2012 Austin ..... F25B 39/04 62/176.1
2015/0054181 A1 * 2/2015 Martin ..... F24F 7/007 261/28
2019/0316849 A1 * 10/2019 Mendez Abrego ..... B60H 1/32331

* cited by examiner

*Primary Examiner* — Elizabeth J Martin
(74) *Attorney, Agent, or Firm* — The Small Patent Law Group LLC; John P. Darling

(57) ABSTRACT

An evaporative cooling system for a radiator and method for retrofitting an existing radiator with an evaporative cooling system is provided. The cooling system includes at least one spray nozzle configured to be connected to the radiator upstream of a radiator core and configured to distribute a mist of water to the radiator core; a water source configured to hold water for conveyance to the at least one spray nozzle; and a conduit assembly for conveying water from the water source to the at least one spray nozzle. The evaporative cooling system provides a quick and inexpensive solution for cooling radiators in situations where short-term extreme temperature events occur.

17 Claims, 9 Drawing Sheets

EVAPORATIVE COOLING SYSTEM

CROSS REFERENCE TO RELATED APPLICATION

This application claims the benefit of U.S. provisional patent application No. 62/661,445, filed Apr. 23, 2018, the contents of which are incorporated herein by reference.

BACKGROUND OF THE INVENTION

Field of the Invention

The present disclosure is directed to an evaporative cooling system for augmenting heat transfer of an air-cooled engine heat exchanger or radiator. More particularly, the present disclosure relates to an evaporative cooling system having an arrangement of misters for applying water mist to the heat exchanger or radiator.

Description of Related Art

Industrial air-cooled heat exchangers cool industrial process fluids or large engines utilizing air that is applied by a fan over tubes that contain the fluid to be cooled. One type of radiator is a charge air cooler or an air-cooled radiator which removes excess heat by allowing the transfer of heat from one fluid (i.e., coolant) to another fluid (i.e., outside air) separated by a medium (such as fins and tubes). Radiators typically include a radiator core in the form of a series of tubes and fins. The tubes are typically secured within a header plate and a fan is provided for moving air across the core. Radiators or charge-air coolers are necessary to prevent engines from overheating. The effectiveness of a radiator can be determined by the following equation, $$\varepsilon = \frac{\text{Actual heat tranfer rate}}{\text{Maximum possible heat transfer rate}}$$

Evaporative cooling has long been utilized in hot, arid atmospheres for cooling purposes. Evaporative cooling uses energy from the surrounding air to evaporate water, which, in turn, releases a latent heat of vaporization and thus lowers the ambient temperature. One example of an evaporative cooling device comprises a swamp cooler, generally indicated as 1 as shown in FIG. 4. This device includes a fan 2, for drawing hot ambient air 4 from the atmosphere through a media 5, such as a series of pads configured for holding water, a water reservoir 6 for supplying water 7 to the media 5. As the hot air 4 is drawn via fan 2 through the wetted media 5, the air picks up moisture. The moisture in the air evaporates, thus releasing the latent heat of vaporization and thus lowering the temperature of the air. This cooled air 8 can then be supplied into a building structure for cooling purposes.

In many applications, a radiator and/or charge air cooler provides cooling to a large diesel engine. The cooling package is sized to accommodate the required heat rejection for a specified maximum ambient temperature; typically, this is referred to as the Limiting Ambient Temperature (LAT). The size of the package is dictated by the LAT requirement even though the ambient temperature may rarely or never be as high as the maximum ambient temperature. This causes the package to be more expensive than necessary. In other cases, the LAT requirement may not be high enough to account for normal high temperatures for the location.

There is a need for a way to quickly and inexpensively cool the radiator and/or charge air cooler in situations where short-term extreme temperature and/or arid conditions exist.

SUMMARY OF THE INVENTION

The primary objectives of the invention are to increase the heat transfer of an air-cooled heat exchanger, decrease the size of cooling package required, and/or provide "peak" cooling for extreme temperature events.

The present invention uses evaporative cooling to lower the apparent ambient temperature that the radiator sees by providing an array of misters, such as water misters, to introduce water droplets to the air flow upstream of the radiator. The water droplets evaporate and the energy of vaporization lowers the dry bulb temperature of the air. This cooling system is especially effective in arid environments where extreme ambient temperature events can occur. It can be appreciated that the cooling system is not limited to a "mister" but could include other water dispersing devices such as foggers, atomizers, nozzles and the like.

In accordance with an embodiment of the present disclosure, an evaporative cooling system for a radiator is provided. The evaporative cooling system includes at least one spray nozzle associated with the radiator and configured to distribute a mist of water to the radiator, a water source configured to hold water for conveyance to the at least one spray nozzle, and a conduit assembly for conveying water from the water source to the at least one spray nozzle. The at least one spray nozzle can comprise a plurality of spray nozzles. According to one embodiment, the plurality of spray nozzles can comprise at least six spray nozzles arranged in spaced relation with respect to each other. According to one design, the spray nozzles can be arranged in a circular pattern in fluid communication with each other via the conduit assembly. It can be appreciated that the spray nozzles can be arranged in other patterns and/or more or less than six nozzles can be provided in order to ensure adequate application of the mist of water to the radiator for cooling purposes. It can also be appreciated that the conduit assembly can be any known fluid conduit, such as a hose, tube, and the like. It can also be appreciated that the conduit assembly can be formed from a flexible, semi-rigid, or rigid material.

The radiator includes a radiator core and the at least one spray nozzle is configured to distribute the mist of water to the radiator core. A fan is provided for causing air to flow across the radiator core, and according to one embodiment, the at least one spray nozzle or plurality of spray nozzles are positioned upstream from the fan. A fan guard is provided on the radiator and according to one embodiment, the at least one spray nozzle or plurality of spray nozzles can be secured to the fan guard. The spray nozzles and/or conduit assembly can be secured to the fan guard by zip ties, cable ties, or any other known fastening devices.

The cooling system can also include at least one thermocouple for monitoring the temperature of the radiator. According to one embodiment, a plurality of thermocouples can be provided including at least one thermocouple associated with the water entering a radiator core and at least one thermocouple associated with the water exiting the radiator core. A humidity sensor can also be associated with the radiator.

The flow rate of water through the at least one nozzle or from the plurality of nozzles can range from approximately 0.5-5.0 gallons per hour and the number of nozzles can range from one to ten, or even more than ten, as necessary. It can be appreciated that the number of nozzles and flow rate therethrough depends on a variety of factors and can be optimized to achieve a desired effective rate of cooling. According to one example, the use of six spray nozzles at a flow rate of approximately 2.53 gallons per hour through each of the nozzles resulted in a 2° C. temperature drop. It has been found the use of the cooling system of the present disclosure has resulted in a radiator having an increase of approximately 12-13% in cooling effectiveness when compared to a radiator without the cooling system. This increase in cooling effectiveness is equivalent to adding approximately 14-15% increase in cooling area.

In accordance with another embodiment of the present disclosure, a method of retrofitting a radiator with an evaporative cooling system is provided. The radiator includes a radiator core, a fan, and a fan guard. The method comprises securing at least one spray nozzle to the radiator fan guard upstream from the fan wherein the at least one spray nozzle is configured to distribute a mist of water to the radiator. The method further comprises providing a water source configured to hold water for conveyance to the at least one spray nozzle and providing a conduit assembly for conveying water from the water source to the at least one spray nozzle. The at least one spray nozzle can comprise a plurality of spray nozzles and the conduit assembly can be configured to connect the plurality of spray nozzles together in fluid communication and in spaced relation with respect to each other. The method further includes securing the plurality of spray nozzles and at least a portion of the conduit assembly to the fan guard using known fastening devices. The conduit assembly can include a hose and the method further comprises connecting the hose to the water source and providing at least one adapter for controlling the flow of water between the plurality of spray nozzles. The use of the evaporative cooling system of the disclosure can result in a 2° C. drop in temperature of the radiator and increase the cooling effectiveness of the radiator by approximately 12-13% or even more than 13%.

In accordance with another embodiment of the present disclosure, a radiator and evaporative cooling system is provided comprising a radiator having a radiator core, a fan, and a fan guard and an evaporative cooling system comprising a least one spray nozzle and a conduit assembly. The spray nozzle is configured to be secured at a location upstream from the radiator fan and the conduit assembly is configured for conveying water from a water source to the at least one spray nozzle to enable the spray nozzle to distribute a mist of water to the radiator. The at least one spray nozzle can comprise a plurality of spray nozzles and the plurality of spray nozzles can be secured to the fan guard. According to one design, the plurality of spray nozzles can comprise at least six nozzles and use of the cooling system can result in a 2° C. drop in temperature of the radiator and increase the cooling effectiveness of the radiator by approximately 12-13%.

These and other features and characteristics of the present invention, as well as the methods of operation and functions of the related elements of structures, and the combination of parts and economies of manufacture will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE INVENTION

Figure 1:
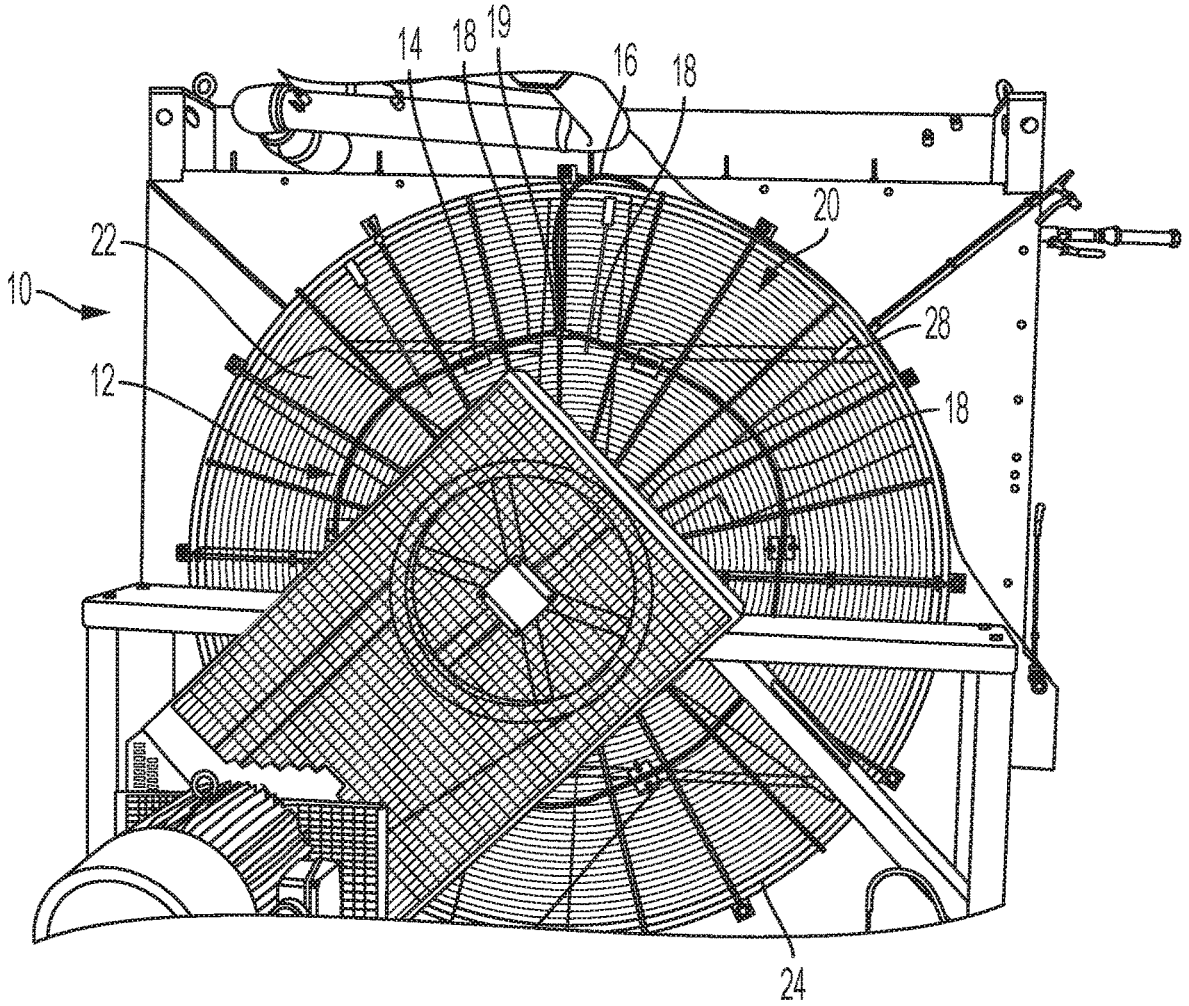
FIG. 1 is a front view of an engine radiator incorporating an evaporative cooling system in accordance with one embodiment of the present disclosure.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings and described in the following specification are simply exemplary embodiments or aspects of the invention. Hence, specific dimensions and other physical characteristics related to the embodiments or aspects disclosed herein are not to be considered as limiting.

The present invention uses an array of water misters, foggers, atomizers, and the like to introduce water droplets to the air flow upstream of the radiator. The water droplets evaporate and the energy of vaporization lowers the dry bulb temperature of the air. The application of this system is intended for arid environments with sufficiently low relative humidity.

According to one example, the cooling system is configured for implementation on radiators for cooling heavy-duty diesel engines for use in trucking, transportation, and railway freight and transportation or any other heavy-duty diesel engine requiring provisions for excessive temporary thermal performance. It can be appreciated that the cooling system is not limited to use with radiators used for cooling diesel engines, but can be used in any type of air cooled heat exchanger.

According to one example, the evaporative cooling system can provide evaporative cooling to an air-cooled diesel engine radiator or any other type of air-cooled heat exchanger by connecting an array of misting devices/nozzles on an incoming air flow side (i.e., vehicle front side) of the radiator fan assembly.

Figure 2:
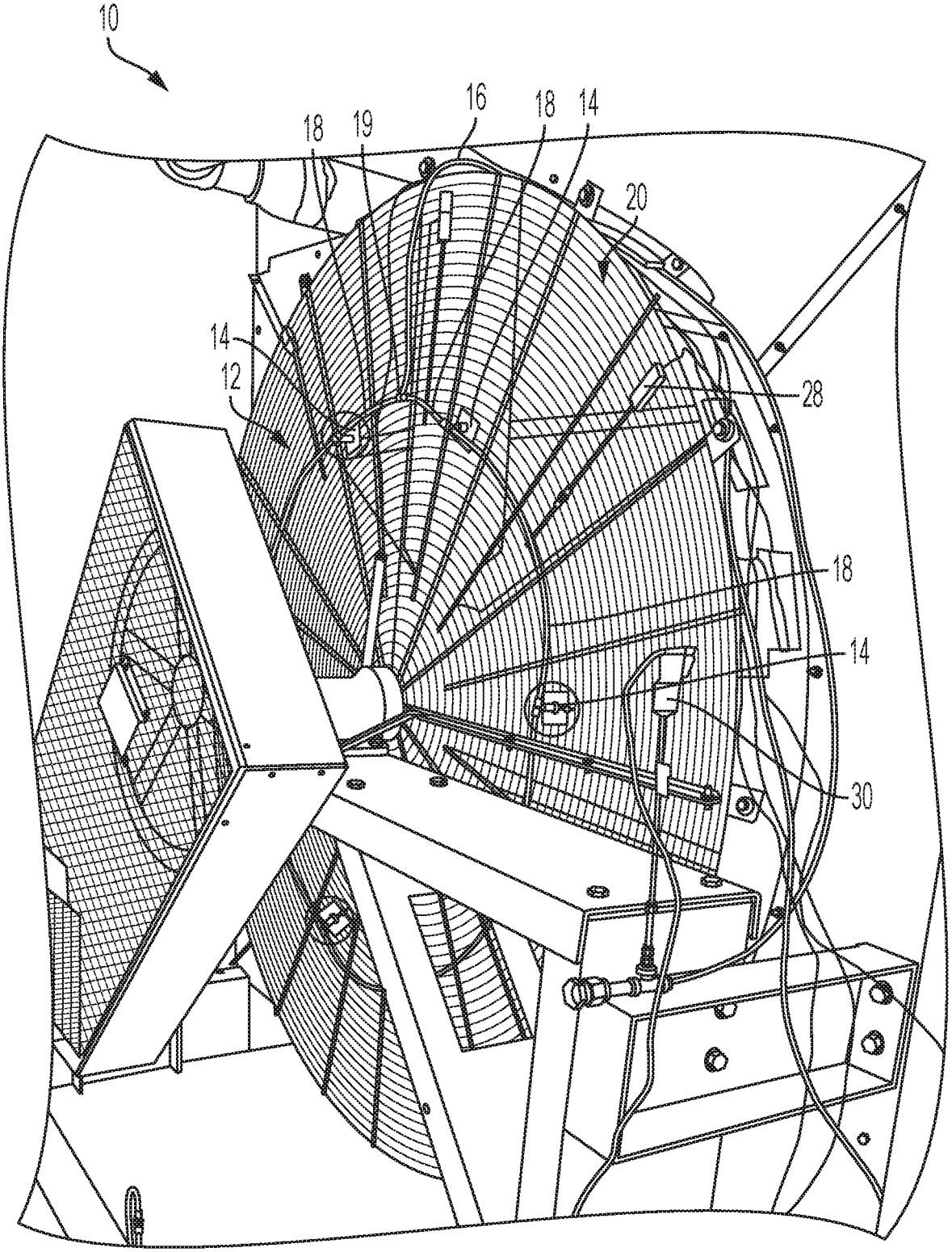
FIG. 2 is a side view of the radiator and evaporative cooling system of FIG. 1 in accordance with one embodiment of the present disclosure.
Figure 3:
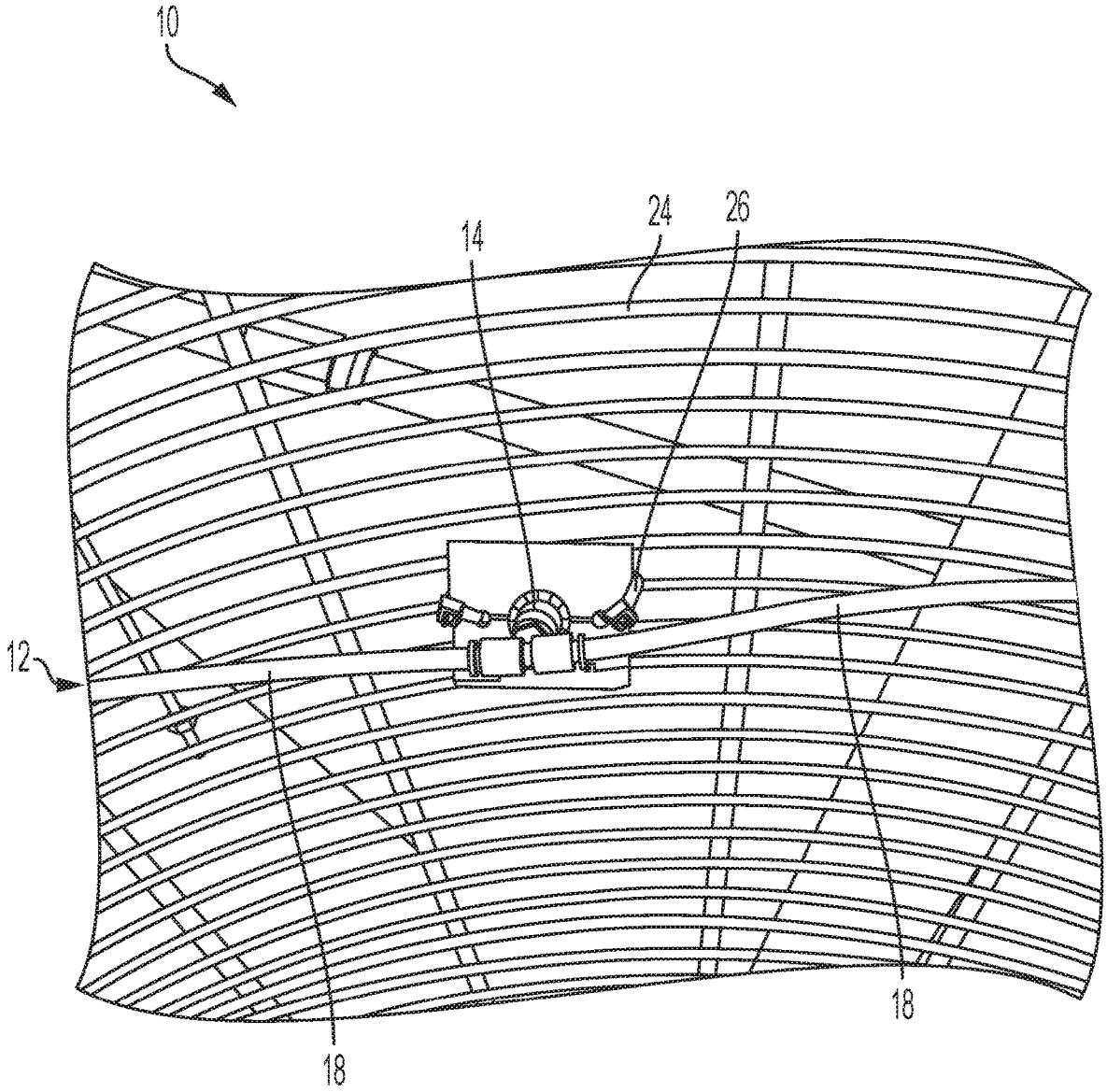
FIG. 3 is an enlarged view of one of the nozzles of the evaporative cooling system of FIG. 1 in accordance with one embodiment of the present disclosure.
Figure 4:
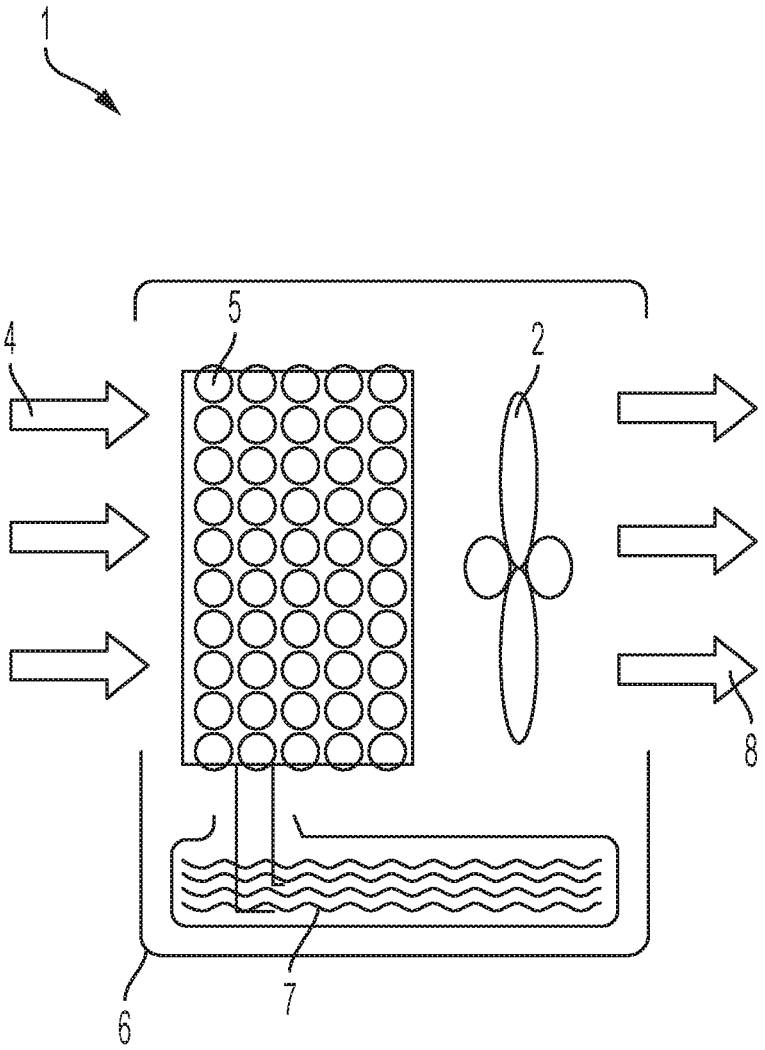
FIG. 4 PRIOR ART
FIG. 4 is a schematic view of an evaporative cooling system in accordance with the prior art.

Reference is now made to FIGS. 1-3, which show a radiator, generally indicated as 10 including an evaporative cooling system, generally indicated as 12, for lowering the apparent ambient temperature that the radiator sees. The evaporative cooling system 12 includes at least one spray nozzle 14, associated with the radiator 10. The spray nozzles 14 are circled in FIG. 2. The spray nozzles 14 are configured to distribute a mist of water to the radiator. The cooling system also includes a water source 16 configured to hold water for conveyance to the at least one spray nozzle 14, and a conduit assembly 18 for conveying water from the water source 16 to the at least one spray nozzle 14. The at least one spray nozzle 14 can comprise a plurality of spray nozzles 14. According to one embodiment, the plurality of spray nozzles 14 can comprise at least six spray nozzles arranged in spaced relation with respect to each other. However, it can be appreciated that the number of spray nozzles can range from one to ten or even more than 10, depending upon the desired level of cooling and the size of the radiator. According to one design, the spray nozzles 14 can be arranged in a circular pattern in fluid communication with each other via the conduit assembly 18 and a series of adaptors 19, i.e., T-shaped, Y-shaped, and the like. It can be appreciated that the spray nozzles 14 can be arranged in other patterns in order to ensure adequate application of the mist of water to the radiator 10 for cooling purposes. It can also be appreciated that the conduit assembly 18 can be any known fluid conduit, such as a hose, tube, and the like and can include various shaped adapters 19, i.e., T-shaped, Y-shaped, and the like to ensure fluid communication through the conduit assembly 18 to the plurality of nozzles 14. It can also be appreciated that the conduit assembly 18 can be formed from a flexible, semi-rigid, or rigid material. According to one design, shown in FIGS. 1 and 2, the water source 16 is attached between the two top spray nozzles 14 and this water supply 16 is split via a Y-shaped adapter 19 into two separate hose portions of the conduit assembly 18.

With continuing reference to FIGS. 1-3, the radiator includes a radiator core, generally indicated as 20, and the at least one spray nozzle 14 is configured to distribute the mist of water to the radiator core 20. A fan 22 is provided for causing air to flow across the radiator core 20 and according to one embodiment, the at least one spray nozzle 14 or plurality of spray nozzles 14 are positioned upstream from the fan 22. A fan guard 24 is provided on the radiator 10, and according to one embodiment, the at least one spray nozzle 14 or plurality of spray nozzles 14 are secured to the fan guard 24. The spray nozzles 14 and/or conduit assembly 18 can be secured to the fan guard by zip ties, cable ties, or any other known fastening device 26.

The evaporative cooling system 12 can also include at least one thermocouple 28 for monitoring the temperature of the radiator 10. According to one embodiment, a plurality of thermocouples 28 can be provided including at least one thermocouple 28 associated with the water entering a radiator core 20 and at least one thermocouple 28 associated with the water exiting the radiator core 20. A humidity sensor 30 can also be associated with the radiator 10, such as by attachment to the fan guard 24 at a location upstream of the nozzles 14.

Figure 5:
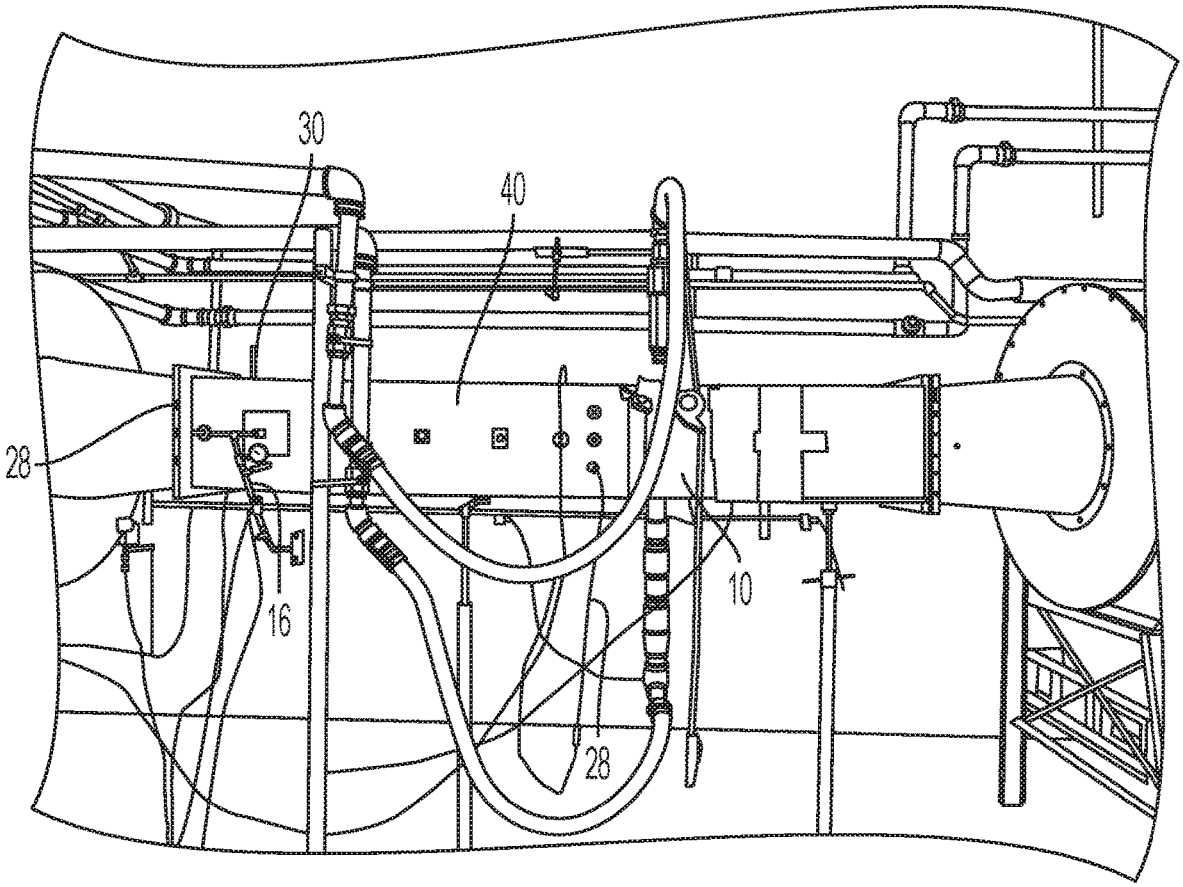
FIG. 5 is a view of a wind tunnel apparatus used to test the evaporative cooling system in accordance with an embodiment of the present disclosure.
Figure 6:
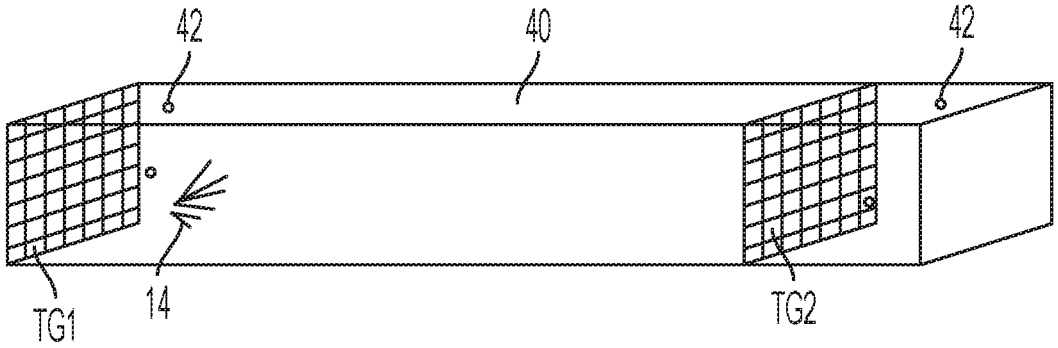
FIG. 6 is a schematic view of a wind tunnel testing apparatus including a radiator structure utilized in testing the cooling system in accordance with an embodiment of the present disclosure.
Figure 7:
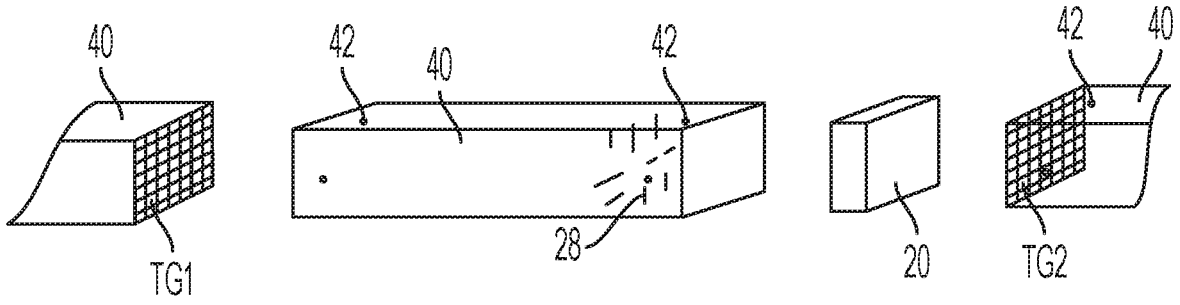
FIG. 7 is a schematic view of a wind tunnel testing apparatus utilized in testing the cooling system in accordance with an embodiment of the present disclosure.
Figure 8:
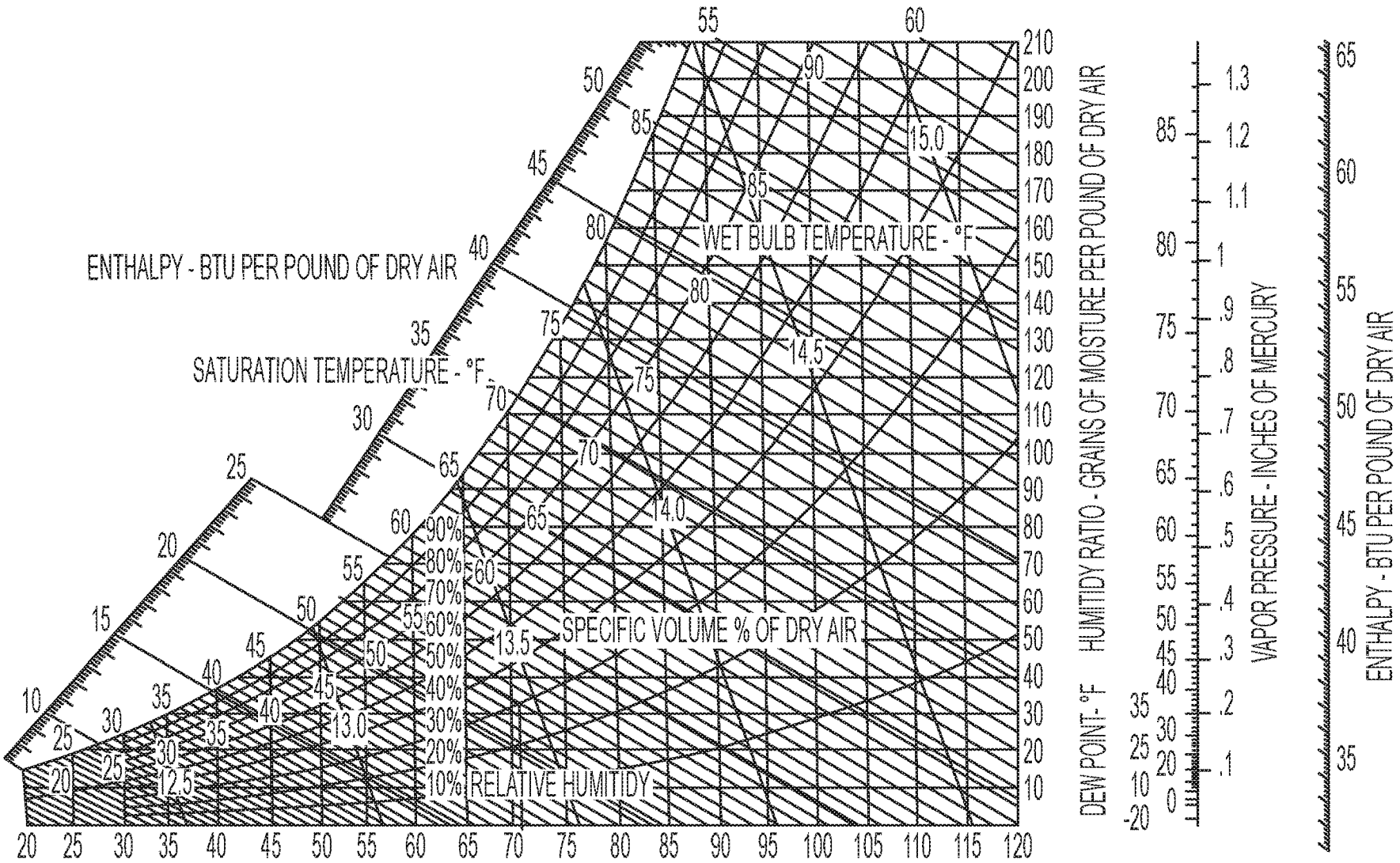
FIG. 8 is a psychometric chart illustrating humidity ratio, vapor pressure, and enthalpy measured during testing of the exemplary evaporative cooling system in accordance with an embodiment of the present disclosure.

Testing of the cooling system was performed using a wind tunnel, as shown in FIGS. 5-7 and discussed in detail below in the Experimental Example. In this example, it was determined that the use of six spray nozzles 14 at a flow rate of approximately 2.53 gallons per hour through each of the nozzles results in an approximate 2° C. temperature drop. It can be appreciated that the number of nozzles and the flow rate therethrough depend upon several factors, including, but not limited to the ambient conditions, the desired degree of cooling, the size of the radiator core, and the like and that this number of nozzles and flow rate can be optimized to achieve the desired cooling. For example, the number of nozzles can range from one to ten, or even more than ten, and the flow rate can range from 0.5-5.0 gallons per hour. It was also determined through testing that the use of the cooling system of the present disclosure results in a radiator having an increase of approximately 12-13% in cooling effectiveness when compared to a radiator without the cooling system. This increase in cooling effectiveness is equivalent to adding approximately 14-15% increase in cooling area.

In accordance with another embodiment of the present disclosure, a method of retrofitting a radiator 10 with an evaporative cooling system 12 is provided. The radiator 10 includes a radiator core 20, a fan 22, and a fan guard 24. The method comprises securing at least one spray nozzle 14 to the radiator fan guard 24 upstream from the fan 22 wherein the at least one spray nozzle 14 is configured to distribute a mist of water to the radiator 10. The method further comprises providing a water source 16 configured to hold water for conveyance to the at least one spray nozzle 14 and providing a conduit assembly 18 for conveying water from the water source to the at least one spray nozzle 14. The at least one spray nozzle 14 can comprise a plurality of spray nozzles 14 and the conduit assembly 18 can be configured to connect the plurality of spray nozzles 14 together in fluid communication and in spaced relation with respect to each other. The method further includes securing the plurality of spray nozzles 14 and/or at least a portion of the conduit assembly 18 to the fan guard 24. The conduit assembly 18 can include a hose, pipe, or other known type of water transfer member, and the method further comprises connecting the hose, pipe, or other known type of water transfer member to the water source 16. One or more adapters 19 (T-shaped, Y-shaped, etc.) can be provided for controlling and/or splitting the flow of water between the plurality of spray nozzles 14. The use of the evaporative cooling system 12 of the disclosure can result in approximately a 2° C. drop in temperature of the radiator 10 and can increase the cooling effectiveness of the radiator by approximately 12-13% or even higher.

In accordance with another embodiment of the present disclosure, a radiator 10 and evaporative cooling system 12 is provided comprising a radiator 10 having a radiator core 20, a fan 22, and a fan guard 24. The evaporative cooling system comprises a least one spray nozzle 14 and a conduit assembly 18. The spray nozzle 14 is configured to be secured at a location upstream from the radiator fan 22 and the conduit assembly 18 is configured for conveying water from a water source 16 to the at least one spray nozzle 14 to enable the spray nozzle 14 to distribute a mist of water to the radiator 10. The at least one spray nozzle 14 can comprise a plurality of spray nozzles 14. The plurality of spray nozzles 14 are configured to be secured to the fan guard 24.

According to one design, the plurality of spray nozzles 14 can comprise at least six spray nozzles 14, which can result in an approximate 2° C. drop in temperature of the radiator, increasing the cooling effectiveness of the radiator by approximately 12-13% which can be equivalent to approximately a 14-15% increase in cooling area.

A coupled empirical/experimental process was used to determine the optimal range of water flow rate, mister selection, airflow rate, air temperature, and air humidity levels. The resultant mathematical model was then used to design site- and radiator-specific mist arrays to achieve desired heat transfer augmentation.

The prototype design goal was shown to create ~12% improvement in overall heat exchanger effectiveness (as defined as q/qmax).

The example also includes the method for sizing required number of misters, water flow rate, expected heat transfer augmentation, flow per mister, water distribution system, system control methodology, and fastening methodology.

Some of the constraints of the present invention include a system that does not inhibit the functioning of the heat exchanger, minimizes leakages or slip hazards, uses easily purchased components and has a simple installation, and the misting system has reasonable flow rate. The advantages achieved by the present disclosure include improved performance and reliability of the heat exchanger by decreasing the air temperature, cost effectiveness, compliance with applicable government safety standards and heat exchanger design standards, economic and environmentally sound usage of water, safety in installation and servicing, simple manufacturing, and sustainability.

Experimental Example

As discussed above, a preliminary working prototype of an evaporative cooling system according to an example of the present disclosure was built and tested in an empirical/experimental process.

With reference to FIGS. 5 and 6, wind tunnel testing was performed within wind tunnel 40 to establish proof of concept of the cooling effect of evaporative cooling system 12 and to measure the performance of the water nozzles and the manner in which they disperse water in an air flow. The wind tunnel was equipped with a temperature grid 1, TG1 at the entrance of the wind tunnel 40 and a temperature grid 2, TG2, at the exit of the wind tunnel 40, various thermocouples 28, a humidity sensor 30, and various pressure sensors 42 at the entrance and exit of the wind tunnel 40.

Figure 9:
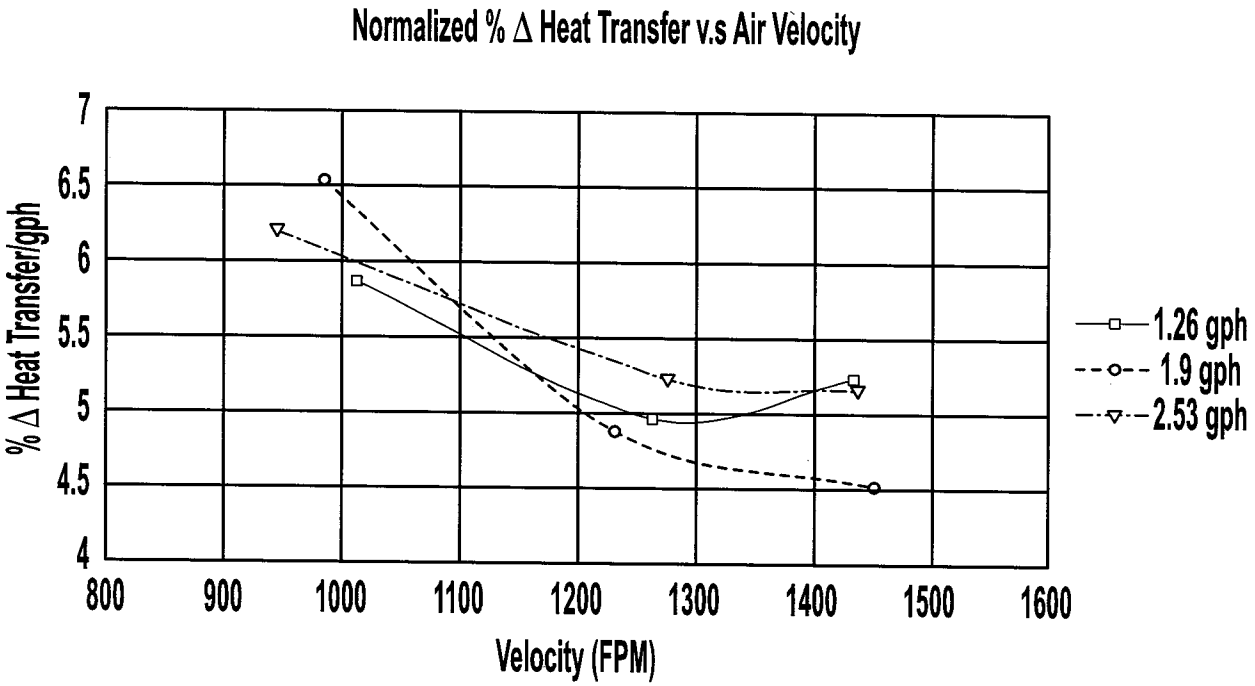
FIG. 9 is a graph comparing heat transfer achieved without the cooling system to heat transfer achieved with the cooling system.

With reference to FIGS. 5-9, wind tunnel testing was then performed in the wind tunnel 40 with a radiator core 20 to compare testing results to the developed mathematical model. In particular, the predicted temperature based on the developed model was compared with the temperatures measured within the wind tunnel 40, and the heat transfer achieved without the nozzles was compared to the heat transfer achieved with the nozzles. As illustrated in FIG. 9, data was generated to choose from 5 different nozzle flow rates: 3.16 gph; 2.53 gph; 1.9 gph; 1.26 gph; and 0.63 gph.

In FIG. 9, the number of nozzles is dependent upon the ambient conditions of the installation, the available airflow of the cooling system, and the availability of pressurized water. The nozzle flow rate is similarly dependent but the effectiveness of increased heat transfer was more highly influenced by the airflow (air velocity). The plot of FIG. 9 was used to determine which nozzle flow rate was most appropriate for the full scale test. Utilizing a decision matrix, 2.53 gph was determined to be the most suitable nozzle flow rate.

Mathematical Model:

$$\text{Energy Balance}—(\dot{Q}_{in}-\dot{Q}_{out})+(\dot{W}_{in}+\dot{W}_{out})+(\dot{Q}_{mass_{in}}-\dot{Q}_{mass_{out}})=0 \quad (1)$$

$$\text{Simplifies to}—(h_{a2}+\omega_2 h_{v2})=(\omega_2-\omega_1)h_f+(h_{a1}+\omega_1 h_{v1}) \quad (2)$$

Assumed a temperature and iterated until both sides of the equation converged.

With reference to FIGS. 1-4, a prototype was designed and built according to the experimental data found during wind tunnel testing. The mathematical model was used to find the number of nozzles needed to achieve the cooling goal. The volume of air through the test core was found through experimental data. According to this one example, it was determined that the choice of nozzle flow rate (2.53 gph) achieved the 2° C. temperature drop desired for a prototype design incorporating six mister devices/nozzles 14. However, it can be appreciated that the number of nozzles and the flow rate therethrough depend upon several factors, including, but not limited to the ambient conditions, the desired degree of cooling, the size of the radiator core, and the like and that this number of nozzles and flow rate can be optimized to achieve the desired cooling. The mister devices/nozzles 14 were placed on the fan guard 22 in the optimum flow region, as shown in FIGS. 1 and 2.

The prototype system was then tested on a radiator 10, as shown in FIGS. 1 and 2. The test setup included 6 thermocouples 28 positioned upstream of the nozzles 14 (attached to the fan guard 24), eight thermocouples positioned downstream of the nozzles (attached to a wooden duct after the core), one thermocouple for water entering the core 20, one thermocouple for water exiting the core, and one thermocouple for the mist temperature. A humidity sensor 30 was attached upstream of the nozzles.

Prototype Testing Results:

$$\text{Heat Transfer vs. Effectiveness}-(3)\varepsilon = \frac{\text{Actual heat tranfer rate}}{\text{Maximum possible heat transfer rate}}$$

Comparing to heat transfer surface area a 12.64% change in effectiveness is equivalent to adding 14.47% increase in area.

TABLE 1

| Mist on/off | Heat Transfer Coolant (kW) | Effectiveness | % Δ Effectiveness |
|---|---|---|---|
| off | 21.96 | 0.30 | 12.64 |
| on | 17.74 | 0.35 | |

The test results point to the effectiveness of evaporative cooling and the application of an evaporative cooling system to a radiator for improving the performance of the radiator.

Alternative examples of the evaporative cooling system may change the location of the mister devices/nozzles to be farther from the fan guard or between the fan and the front of the radiator core.

It is envisioned that this invention can be used in connection with a variety of different types, styles and models of air-cooled heat exchanger units, circuits or cores, wherein the series of tubes is laid out according to various arrangements. The cooling system of the present invention can be used with heat exchangers having any type of fin and tube arrangement. These arrangements include, but are not limited to, staggered, parallel, canted, plate fin, Serpentine, CT, and the like.

While specific embodiments of the invention have been described in detail, it will be appreciated by those having ordinary skill in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof.

The invention claimed is:

1. An evaporative cooling system for a radiator, the cooling system comprising:

at least one spray nozzle associated with the radiator and configured to distribute a mist of water to the radiator;

a water source configured to hold water for conveyance to the at least one spray nozzle; and a conduit assembly for conveying water from the water source to the at least one spray nozzle, wherein the radiator includes a radiator core and the at least one spray nozzle is configured to distribute the mist of water to the radiator core, the radiator includes a fan for causing air to flow across the radiator core and wherein the at least one spray nozzle is positioned upstream from the fan, and the at least one spray nozzle is secured to a fan guard provided on the radiator.

2. The cooling system of claim 1, wherein the at least one spray nozzle comprises a plurality of spray nozzles.

3. The cooling system of claim 2, wherein the plurality of spray nozzles comprises at least six spray nozzles arranged in spaced relation with respect to each other.

4. The cooling system of claim 2, wherein the plurality of nozzles are associated with the conduit assembly and in fluid communication with each other and wherein the plurality of nozzles are mounted in a circular arrangement.

5. The cooling system of claim 1, wherein the at least one spray nozzle comprises a plurality of spray nozzles and the plurality of spray nozzles are secured to the fan guard at spaced relation with respect to each other.

6. The cooling system of claim 1, including at least one thermocouple for monitoring the temperature of the radiator.

7. The cooling system of claim 6, wherein the at least one thermocouple comprises a plurality of thermocouples including at least one thermocouple associated with the water entering a radiator core and at least one thermocouple associated with the water exiting the radiator core.

8. The cooling system of claim 1, including a humidity sensor associated with the radiator.

9. The cooling system of claim 1, wherein the at least one spray nozzle comprises six spray nozzles and wherein a flow rate of water through each of the spray nozzles is approximately 2.53 gallons per hour.

10. The cooling system of claim 1, wherein the radiator with the cooling system has an increase of approximately 12%-13% in cooling effectiveness when compared to a radiator without the cooling system.

11. A method of retrofitting a radiator with an evaporative cooling system, said radiator including a radiator core, a fan, and a fan guard provided on the radiator, the method comprising:

securing at least one spray nozzle to the fan guard provided on the radiator upstream from the fan, the at least one spray nozzle configured to distribute a mist of water to the radiator;

providing a water source configured to hold water for conveyance to the at least one spray nozzle; and providing a conduit assembly for conveying water from the water source to the at least one spray nozzle.

12. The method of claim 11, wherein the at least one spray nozzle comprises a plurality of spray nozzles and the conduit assembly is configured for connecting the plurality of spray nozzles together in fluid communication and in spaced relation with respect to each other and wherein the method further includes securing the plurality of spray nozzles and at least a portion of the conduit assembly to the fan guard.

13. The method of claim 12, wherein the conduit assembly includes a hose and the method includes connecting the hose to the water source and providing at least one adapter for controlling the flow of water between the plurality of spray nozzles.

14. The method of claim 11, wherein the method comprises securing at least six water nozzles to the fan guard and wherein use of the evaporative cooling system results in a 2° C. drop in a temperature of the radiator and increases the cooling effectiveness of the radiator by approximately 12-13%.

15. A radiator and evaporative cooling system comprising a radiator having a radiator core, a fan, and a fan guard provided on the radiator and an evaporative cooling system comprising a least one spray nozzle and a conduit assembly, wherein the spray nozzle is configured to be secured at a location upstream from the radiator fan and wherein the conduit assembly is configured for conveying water from a water source to the at least one spray nozzle to enable the spray nozzle to distribute a mist of water to the radiator.

16. The system of claim 15, wherein the at least one spray nozzle comprises a plurality of spray nozzles and wherein the plurality of spray nozzles are configured to be secured to the fan guard.

17. The system of claim 16, wherein the plurality of spray nozzles comprises at least six nozzles.

* * * * *